United States Patent [19]

Littlehorn, Jr.

[11] 4,291,507

[45] Sep. 29, 1981

[54] HIGH SPEED GRINDING WHEEL FOR GLASS

[76] Inventor: John J. Littlehorn, Jr., 4530 South Broadway, Englewood, Colo. 80110

[21] Appl. No.: 98,185

[22] Filed: Nov. 28, 1979

[51] Int. Cl.[3] ..... B24D 9/02

[52] U.S. Cl. ..... 51/374

[58] Field of Search ..... 51/141, 170 T, 170 PT, 51/357, 358, 372–375, 401, 406, 407; 15/230, 230.11; 29/120, 121.5, 129

[56] References Cited

U.S. PATENT DOCUMENTS

| | | | |
|---|---|---|---|
| 451,391 | 4/1891 | Davis | 29/129 |
| 1,182,162 | 5/1916 | Furber | 15/230 |
| 2,257,864 | 10/1941 | Sheehan | 51/141 |
| 2,378,643 | 6/1945 | Losey | 51/141 |
| 2,687,600 | 8/1954 | Larson | 51/374 |
| 3,029,566 | 4/1962 | Simendinger | 51/141 |
| 3,597,883 | 8/1971 | Choplin | 51/372 |
| 3,875,703 | 4/1975 | Clemente | 51/170 T |

*Primary Examiner*—Harold D. Whitehead
*Assistant Examiner*—K. Bradford Adolphson
*Attorney, Agent, or Firm*—Ralph F. Crandell

[57] ABSTRACT

A resilient disc shaped wheel and supported abrasive belt for grinding glass. A central bore in the wheel provides for mounting to a rotating drive shaft driven by a motor. Circumferentially spaced radially extending slits are disposed incrementally around the entire circumference of the wheel, defining flexible teeth therebetween. The slits are cut only a portion of the way through the wheel leaving a continuous membrane of resilient material tending to hold the teeth in position upon rotation. An abrasive belt is positioned around the outer perimeter of the wheel, and held in place by the centrifugal forces imparted to the teeth.

1 Claim, 5 Drawing Figures

HIGH SPEED GRINDING WHEEL FOR GLASS

BACKGROUND OF THE INVENTION

1. Field of the Invention

This invention relates to grinding wheels, and more particularly to high rotational velocity grinding wheels of the type that are capable of grinding hard and brittle materials, such as glass.

2. Description of the Prior Art

Rigid grinding wheels of disc-like shape rotating at relatively slow speeds and having abrasive surfaces are well known in the art. In using such a wheel on a glass surface there is considerable risk of fracturing the glass. The hard and brittle nature of glass does not readily accept forces transmitted through a rigid, rotating wheel.

Soft, elastic wheels having an integral abrasive surface have been utilized. In order to attain the desired resilience, however, the wheel composition will rapidly erode away. Continued replacement of wheels, which are quite expensive, is therefore necessary. Use of a resilient grinding wheel and an add-on abrasive surface has slippage problems. Any adhesive used will eventually break down with use, and gluing generally provides insufficient bonding between the resilient member and the abrasive surface.

OBJECTS AND SUMMARY OF THE INVENTION

The principle object of the present invention is to provide a grinding wheel for hard and brittle materials, such as glass, that is less likely to fracture the material being ground.

A related object of the present invention is to provide a flexible and resilient grinding wheel capable of expanding to retain a continuous abrasive surface for the purpose of grinding glass or similar brittle materials.

A further object of the present invention is to provide a resilient and flexible grinding wheel having an extended useful life.

Another and further object of the present invention is to provide a grinding wheel that can utilize two surfaces for grinding.

In accordance with the objects of the present invention, a wheel of rubber or elastic material is provided, having a specified hardness or rigidity. A bore through the center of the wheel is provided for mounting the wheel to an axle which is rotatably driven by a motor or similar power source. The outer periphery of the rubber or elastic wheel is provided with a high number of slits, relative to the circumference of the wheel, spaced in equal increments around the perimeter.

The slots or slits are numerous enough so that the exterior surface, or rim, of the grinding wheel flexes and deflects as it is pushed against a surface. Teeth are thereby formed between the slots. In order to maintain the integrity of the teeth of the wheel, the slots are formed through only a portion of the thickness of the wheel, leaving a continuous membrane of original material intact. This membrane acts to keep the teeth from encountering excessive rotational forces which might tend in time to break off a tooth.

In order to provide an abrasive grinding surface, a continuous abrasive belt of slightly less diameter than the wheel is snugly fitted to the exterior periphery of the wheel. The belt is held in place by the expanding teeth upon rotation of the wheel at high speed.

DESCRIPTION OF THE PREFERRED EMBODIMENT

Figure 1:
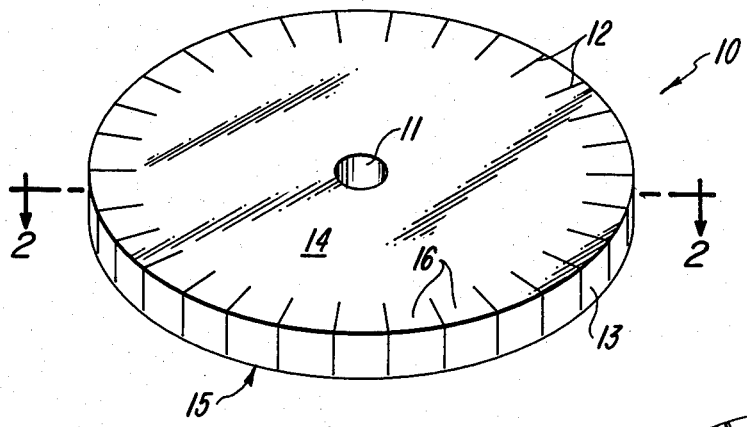
FIG. 1 is an isometric view of a grinding wheel embodying the present invention.
Figure 2:
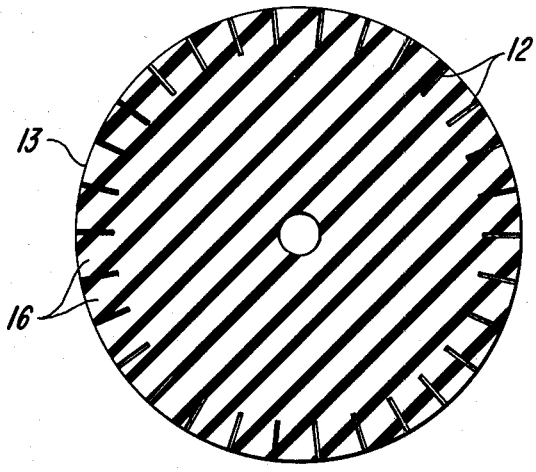
FIG. 2 is a section view taken substantially in the plane of line 2—2 on FIG. 1.

The present invention comprises a grinding wheel 10 made of an elastic material, such as rubber, of disc-like configuration, as shown in FIG. 1. Polymeric and other resilient materials other than rubber are of course suitable. For mounting the wheel 10 on the shaft of a motor or other suitable power source, there is provided a bore 11, either drilled or formed through the center of the wheel 10. At short distances, relative to the wheel diameter, around the periphery of the wheel are formed or machined a plurality of radially directed slits 12. The slits are narrow slots extending a predetermined distance, again relatively short in comparison to the diameter of the wheel 10, toward the center of the disc. As clearly shown in FIG. 2, the slits are of a radial depth equal to about one-sixth of the radius of the wheel, and are spaced apart a circumferential distance approximately equal to their radial depth. The slits are formed or machined through a substantial portion, but not all, of the thickness of the wheel 10.

Figure 3:
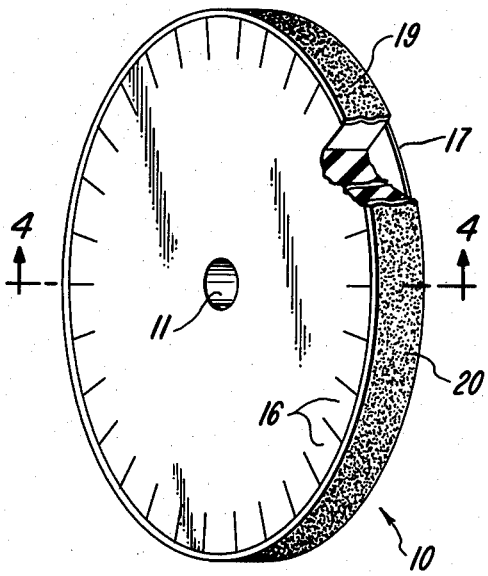
FIG. 3 is an isometric perspective view of the present invention with a portion of the grinding wheel and abrasive belt broken away for clarity in illustration.

The configuration of the slits 12 creates two distinct sides to the wheel 10. A slitted side 14 is formed on the side where the slits extend above the surface of the disc. The opposite side remains an unbroken surface on side 15. Alternating between the slits are teeth 16 integrally connected to the wheel, being formed intermediate the slits 12 on the slitted side 14. Integrally connecting the teeth, on the unbroken side 15, is a continuous membrane 17 of the residual elastic or resilient material remaining after the slits 12 are formed through a portion of the thickness of the wheel. The membrane 17 extends completely around the periphery of the wheel 10 and joins protruding teeth 16. (FIG. 3)

Figure 4:
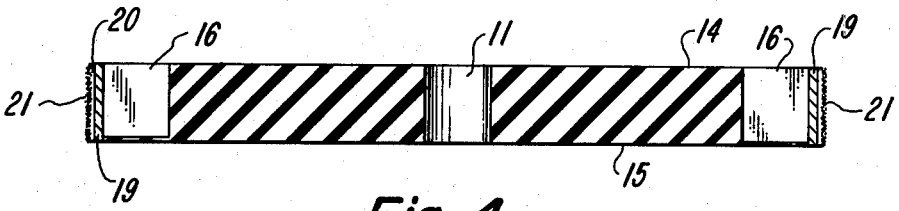
FIG. 4 is a section view taken substantially in the plane of line 4—4 on FIG. 3.

The rim 13 of the wheel 10 is formed by the protruding ends of the integral teeth 16 and the continuous membrane 17. (FIG. 4) Around the rim is fitted a continuous circumferential abrasive belt 19 of diameter slightly less than that of the wheel 10, including the teeth 16. (FIG. 3) The abrasive belt 19 is actually the grinding surface, which as rotated on the wheel 10, abrades the working surface for finishing or fitting purposes.

Because of the resilient nature of the wheel 10, as well as the flexibility obtained by forming the slits 12 around the periphery of the wheel 10, the abrasive belt 19 can be tightly fit and held around the wheel 10. In this manner, proper alignment of the wheel is maintained.

The wheel 10 is so constructed that a rotational speed imparted by a motor or other drive means (not shown) can reach about 3,500 r.p.m. At this speed, the centrifugal force tends to elementally urge the teeth 16 outwardly from their normal relationship relative to the slitted side 14 of the disc 10. This results in an effectively larger diameter at high r.p.m. which assists in maintaining the abrasive belt 19 in proper relationship to the grinding wheel 10.

At high r.p.m. a too flexible or soft disc is highly unstable. On the other hand, a grinding disc that is too hard, has no give, has no flexibility, and tends to break hard and brittle materials such as glass that are sought to be ground by the present invention. It has been found that rubber, or other resilient material, having a hardness factor of between 30 and 100 durometer is useful, and preferably the rubber has a hardness of about 60 durometer. A hardness below about 30 is too light and the wheel is too soft. A hardness above about 100 results in a wheel which is too hard and fractures or shatters glass.

Figure 5:
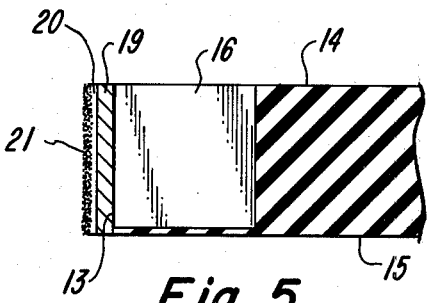
FIG. 5 is an enlarged end portion of the view shown in FIG. 4.

It has further been found that a continuous belt of sanding or grinding material, having a grit of between 24 and 800 mesh is preferred. Preferably a particle size of between 120 and 180 mesh has been found to produce the best results. Grinding materials for fixing to the belt may include diamond, silicon carbide and aluminum oxide, while the belt medium can be cloth, polyurethane, polyester, paper or other suitable base materials. An adhesive 20 holds the grit 21 to the belt 19 as shown in FIG. 5.

The grinding wheel 10 of the present invention also lends itself to use of a circular sanding disc (not shown) on the unbroken side 15 of the wheel. The sanding disc is usually placed on the shaft of the grinding device after mounting the wheel 10. The surface side 15 is then capable of cooperating with the abrasive belt 19 to grind a wide variety of glass surfaces.

While an illustrative embodiment of the present invention has been shown in the drawings and described above in considerable detail, it should be understood that there is no intention to limit the invention to the specific form disclosed. On the contrary, the intention is to cover all modifications, alternative constructions and processes, equivalents and uses falling within the spirit and scope of the invention as expressed in the appended claims.

What I claim is:

1. A high speed grinding wheel having a narrow continuous abrasive belt for grinding glass and like brittle materials, comprising a narrow, flat, disc-shaped body of flexible, resilient material having a hardness factor of between about 30 and about 100 durometer, said body defining parallel, spaced, opposed, circular faces joined at their circumferences by a narrow, cylindrical, peripheral surface, a plurality of relatively short, thin, radial slits equidistantly defined in said body around the circumference thereof and opening into said peripheral surface thereof and into one of said faces, said slits being spaced apart a distance approximately equal to the radial depth thereof and having a depth equal to about one-sixth of the radius of the wheel, the other of said faces being unbroken by said slits, said abrasive belt being snugly supported on and completely surrounding said peripheral cylindrical surface during grinding use thereof.

* * * * *